United States Patent [19]

Sakamoto

[11] Patent Number: 4,565,031

[45] Date of Patent: Jan. 21, 1986

[54] RAIL ARRANGEMENT FOR FLUSH SLIDING DOOR PANELS

[75] Inventor: Kazuhiko Sakamoto, Tokyo, Japan

[73] Assignee: Sugatsune Industrial Co., Ltd., Tokyo, Japan

[21] Appl. No.: 574,881

[22] Filed: Jan. 30, 1984

[30] Foreign Application Priority Data

Feb. 2, 1983 [JP] Japan ..... 58-15903
Dec. 31, 1983 [JP] Japan ..... 58-251425

[51] Int. Cl.[4] ..... E05D 15/20
[52] U.S. Cl. ..... 49/130; 49/127
[58] Field of Search ..... 49/127, 128, 130

[56] References Cited

U.S. PATENT DOCUMENTS 1,996,310 4/1935 Skoogh ..... 49/130
2,819,498 1/1958 Grossman ..... 49/130
2,893,071 1/1959 Oden ..... 49/130
2,896,274 7/1959 Chris ..... 49/130
4,384,429 5/1983 Rokicki et al. ..... 49/130

*Primary Examiner*—Kenneth Downey
*Attorney, Agent, or Firm*—George B. Oujevolk

[57] ABSTRACT

A double panel sliding door arrangement where the two panels will lie in one plane when shut, said arrangement comprises upper and lower rails disposed on upper and lower wall portions of a door mounting frame to laterally move and guide right and left door panels by means of rollers provided at the upper and lower ends of the right and left sliding panels. The rails each have at the right and left sides thereof an oblique portion bent backwards, a rail switching portion and a guide portion in such a manner that one panel can be shifted beforehand, and to switch the rail. The sliding panels can be fully closed without a gap between the panels with only one rail without the necessity of chamfering the inner ends of the panels.

4 Claims, 26 Drawing Figures

RAIL ARRANGEMENT FOR FLUSH SLIDING DOOR PANELS

BACKGROUND OF THE INVENTION

This invention relates to a rail arrangement in which sliding door panels which are abutted at the inner side edges thereof in an opening of a cabinet or the like are so disposed in the shut state that one door panel can be shifted from the shut state to be slidably superposed over the other panel.

Conventional double sliding door arrangements are constructed with steps formed between both door panels which spoils the beauty and design. Also, these sliding door panels cannot be openably moved to a superposed state in a structure without forming a gap between the abutting inner ends of the panels. The sliding door panels cannot be completely closed in this construction, or, the panels cannot be operably moved if the abutting inner ends of the panels are not obliquely chamfered. These problems of the conventional sliding doors causes difficulties in their use in an openable state and an increase in manufacture and cost.

SUMMARY OF THE INVENTION

Accordingly, a primary object of this invention is to provide a sliding door rail arrangement which is adapted to completely cover an opening of a cabinet or the like and to greatly reduce any gap between an outer wall and between the sliding panels in such a manner that the sliding panels can be fully closed without a gap between the sliding panels with only one rail without the necessity of chamfering the inner ends of the panels which are in a readily mountable state. This object is accomplished by the structure hereinafter described and comprises a door rail disposed on an upper wall portion for the right and left double sliding door panels, and a lower door rail disposed on a lower wall portion of a door mounting frame to laterally movably guide the right and left panels by runners, e.g., rollers provided at the upper and lower ends of the sliding panels. These rails each have at the right and left sides thereof an oblique portion bent backwards, a rail switching portion and a guide portion in such a manner that one door panel can be shifted beforehand to switch the rail.

Another object of this invention is to provide a device which can stably support right and left double sliding panels by means of two runners or rollers provided laterally of the panels with the capability of opening the door panels in such a manner that the gap between the upper wall portion and the lower wall portion of the door mounting frame can be greatly reduced and the gap between the panels in the closed state is greatly reduced or is eliminated completely, also, the inner ends of the panels are not notched or chamfered and only one rails is provided in a simple structure to be readily inexpensively mounted in an opening of a cabinet or the like. This object is is achieved by brackets fixedly secured to the outer ends of the right and left sliding panels, an upper door rail disposed on an upper wall portion, a lower door rail disposed on a lower wall portion for the double sliding doors, of a door mounting frame to laterally movably guide the double sliding panels by rollers provided on arms extended toward the inner ends of the double sliding doors from the brackets, said door rails each having at the right and left side parts of a central linear portion thereof an oblique portion bent backwards, and a door reserving portion integrated backwards in a manner substantially perpendicularly from the linear portion in such a manner that the double sliding panels can rotate forwardly at the initial time of opening the doors and the sliding panels can be moved in a superposed state at the door opening time so that the brackets and the arms can be superposed. The above and other related objects and features of the invention will be apparent from a reading of the following description of the disclosure found in the accompanying drawings and the novelty thereof pointed out in the appended claims.

DESCRIPTION OF THE PREFERRED EMBODIMENT

The present invention will now be described in more detail with reference to the accompanying drawings.

Figure 1:
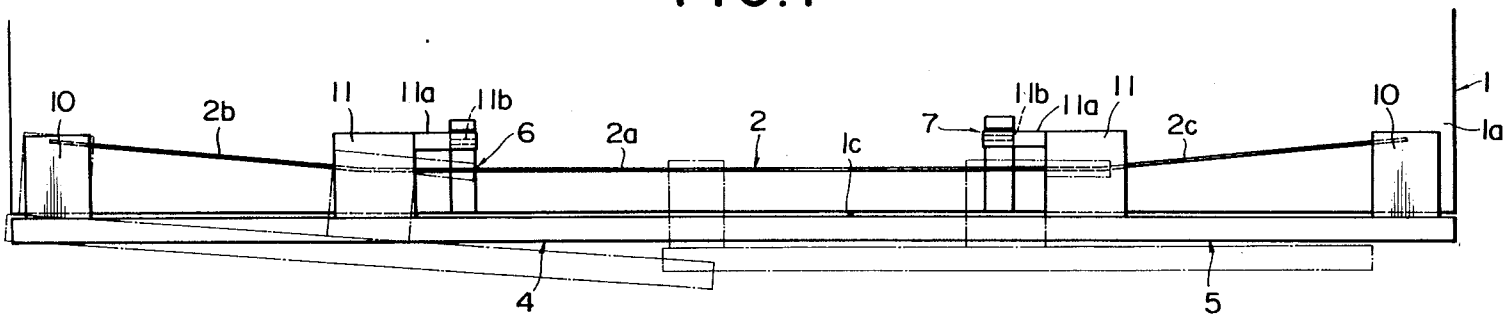
FIGS. 1 and 2 are plan and bottom views respectively showing the state of double sliding door rails constructed according to the present invention.
Figure 2:
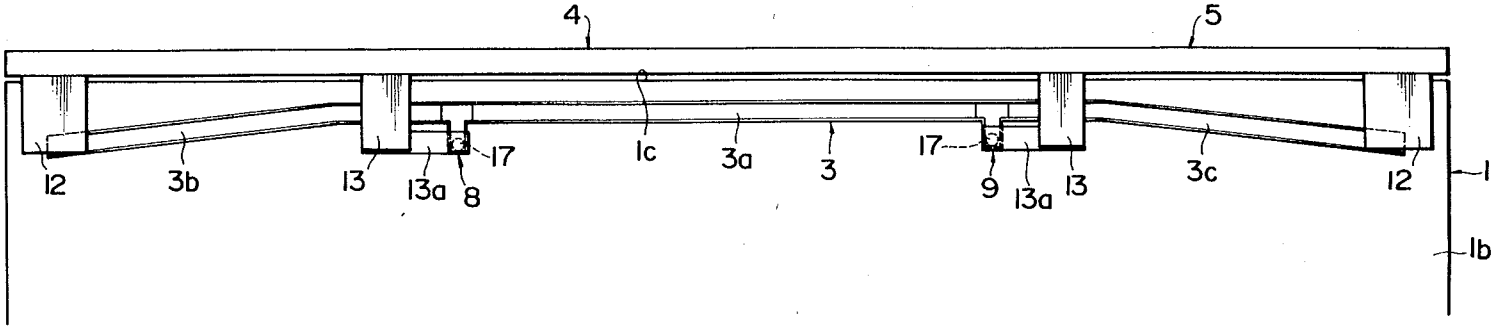
Figure 3:
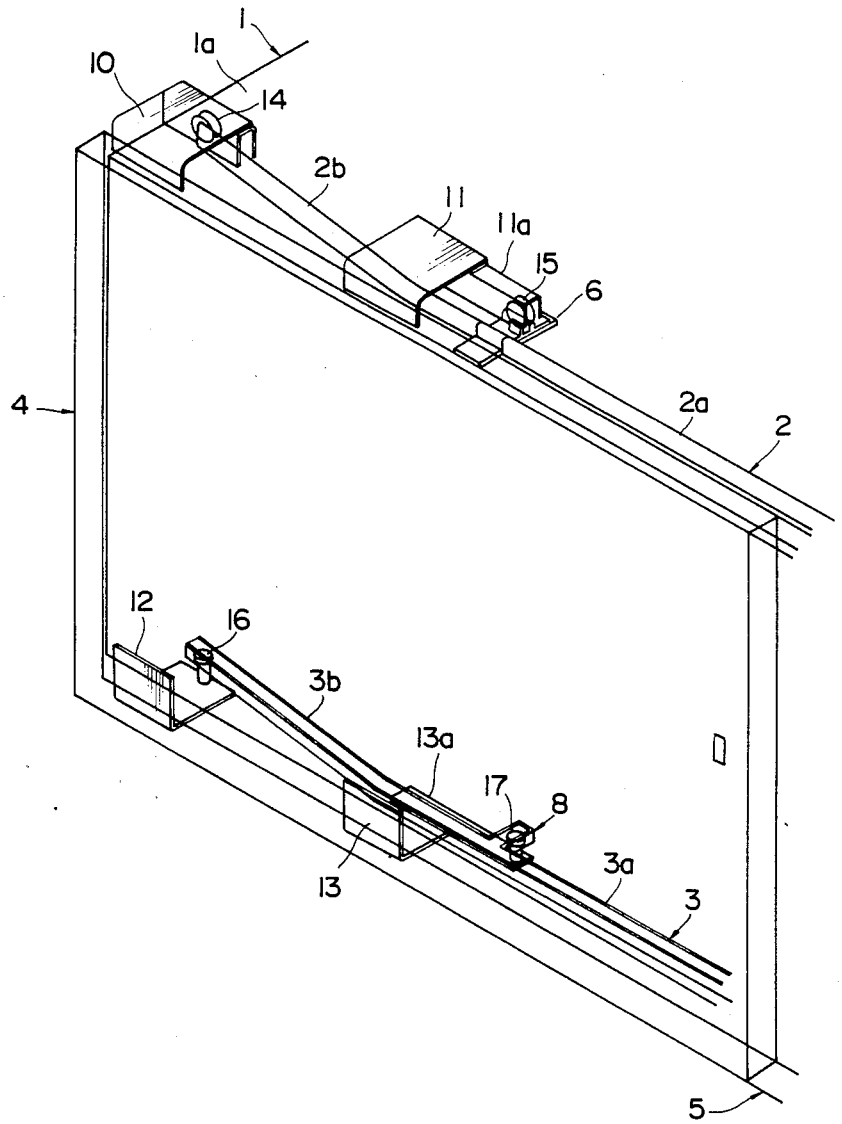
FIG. 3 is a perspective view showing the closed state of double sliding panels on the rails of a door mounting frame.
Figure 4:
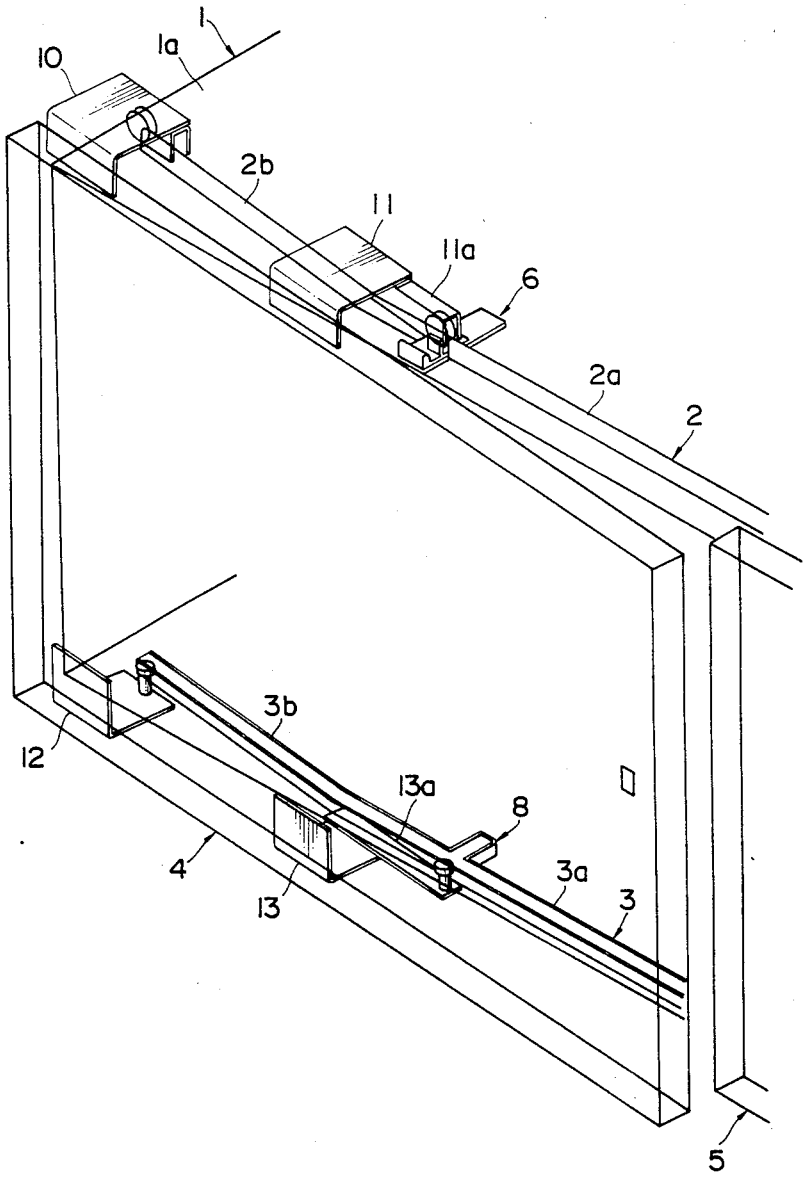
FIG. 4 is a perspective view showing the initial state of opening the double sliding doors on the rails.
Figure 5:
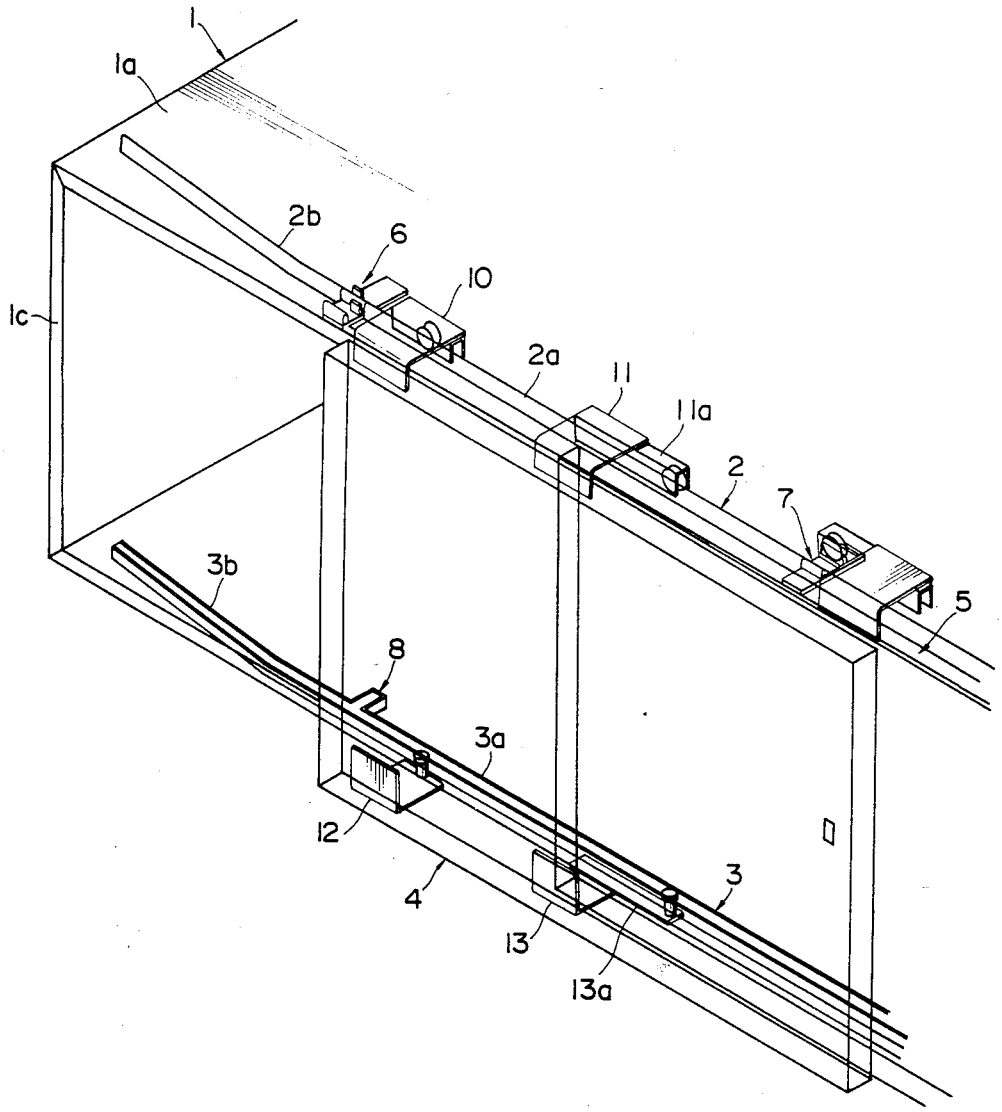
FIG. 5 is a perspective view showing the opened state of the doors on the rails.

As shown in FIGS. 1 and 2, door rails 2 and 3 are laid on upper and lower wall portions 1*a* and 1*b* of a door mounting frame 1 for a cabinet or the like.

The rails 2 and 3 have at the center thereof linear portions 2*a* and 3*a* for slidably guiding left and right panels 4 and 5 in parallel with the opening edge 1*c* of the frame 1, oblique portions 2*b*, 2*c* and 3*b*, 3*c* bent backwardly at both outsides of the linear portions 2*a* and 3*a* so as to longitudinally tiltably move the doors 4 and 5 at least in the amount equal to or longer than the thickness of the door at the initial time of opening or closing the doors, rail switching portions 6 and 7 provided in the vicinity of both ends of the linear portion 2*a* of the door rail 2 to hang the door panel so as to be able to shift the panel and move the panel in the first shifted state, and guide portions 8 and 9 in the vicinity of the both ends of the linear portion 3*a* on the door rail 3 to guide the panels so as to be able to shift the panels 4 and 5 as described.

As shown in FIGS. 1 through 5, runners 14, 15 and 16, 17 such as rollers engage with the door rails 2 and 3 at the doors 4 and 5 at the outer ends and at the centers at fittings 10, 11 and 12, 13 which project backwards from the upper and lower back surface ends of the doors 4 and 5 in the opening of the frame 1. The rails 2 and 3 are clamped at the frame 1 by screws or the like between the panels 4 and 5 without a gap between the opening edge 1*c* and the panels 4 and 5 in such a manner that the mounting positions are preset.

In this embodiment, the rails are provided in a projected state. However, the rails may be formed in formed in a recessed groove shape and runners may be engaged with the grooves as will be described later with respect to another embodiment of the present invention.

The rail switching portions 6 and 7 are provided to shift one panel from the other door so that one door is superposed on the other door to be slidable laterally at the time of opening the doors 4 and 5 and to reversibly shift back the one panel from the other panel so that the panels 4 and 5 are returned so as to be in the same plane state to close the doors, and are also provided to guide the runners 14, 15 and 16, 17 to shift either one panel 4 or 5 from the other panel 5 or 4 so that either one panel 4 or 5 is completely superposed on the other panel 5 or 4.

Figure 8:
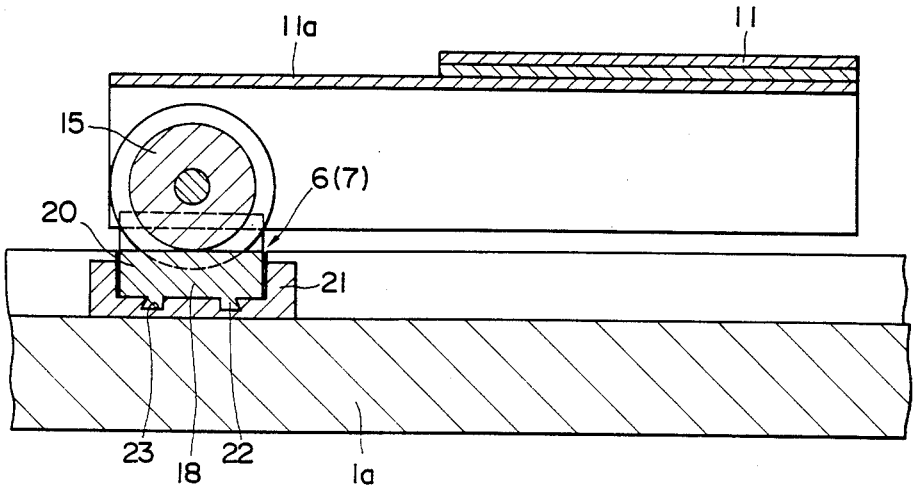
FIGS. 8 and 9 are front and side longitudinal sectional views of a rail switching portion of the door rail.
Figure 9:
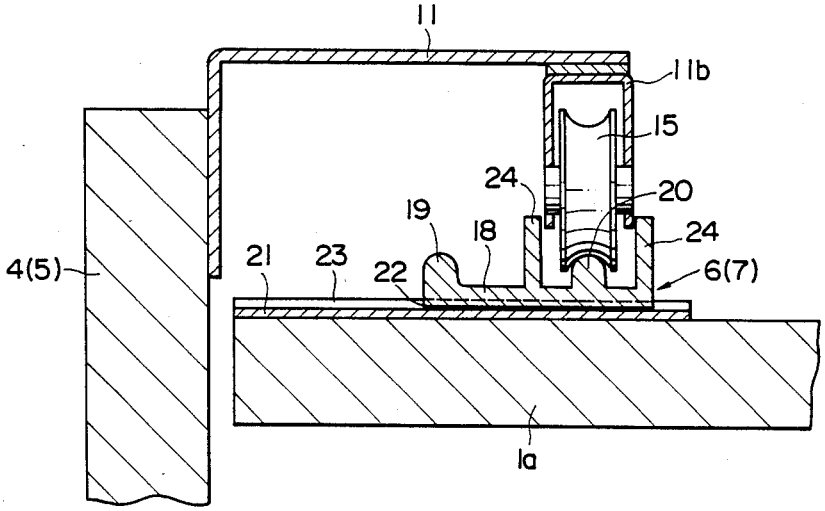

The rail switching portions 6 and 7 are, as shown in FIGS. 8 and 9, constructed to have two rail portions 19 and 20 aligned on a base plate 18 in such a manner that the base plate 18 is engaged with a guide plate 21 by dovetail tenons 22 formed at the base plate 18 and dovetail grooves 23 formed at the guide plate 21 and are slidable in a direction perpendicular to the longitudinal direction of the rail portions 19 and 20, the guide plate 21 is secured onto the upper wall portion 1*a* of the frame 1 substantially perpendicularly to the longitudinal direction of the door rail 2 disposed on the upper wall portion 1*a* of the frame 1 in such a manner that the rail portions 19 and 20 may be selectively disposed on the slideable base plate 18 to be able to be shifted as part of the linear portion 2*a* of the door rail 2 disposed on the upper wall portion 1*a* of the frame 1.

Retainers 24 for the runner 15 are located at both the right and left of the rail portion 20 on the base plate 18 to retain runner 15 from the rail portion 20 when the panel 4 or 5 is longitudinally moved, and used to slide the base plate 18 so as to shift the rail portions 19 and 20 from the linear portion 2*a* of the rail 2.

The fitting 11 is formed in an L shape as seen from the side, the runner 15 is, as shown in the drawings, rotatably journaled through the fitting 11*b* of U-shaped section to the extended end 11*a* which extends sidewise from the end thereof, and the runner for the panel 4 or 5 to be opened is guided to the rail portion 19 at the panel closing time in FIG. 1 in which the other rail portion 19 is disposed to bring the linear portion 1*a* of the rail 2 coincident to the oblique portions 2*b* or 2*c*.

Figure 11:
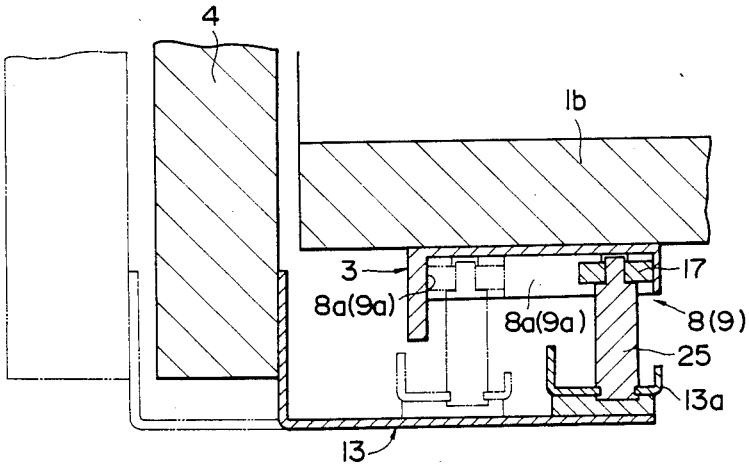

On the other hand, the fittings 13 which are secured to the lower centers of the panels 4 and 5 are constructed substantially in the same manner as the fitting 11, and the runner 17 is rotatably supported, as shown in FIG. 11, to a stud shaft 25 which extends from the extended end 13*a* of the fitting 13.

Figure 10:
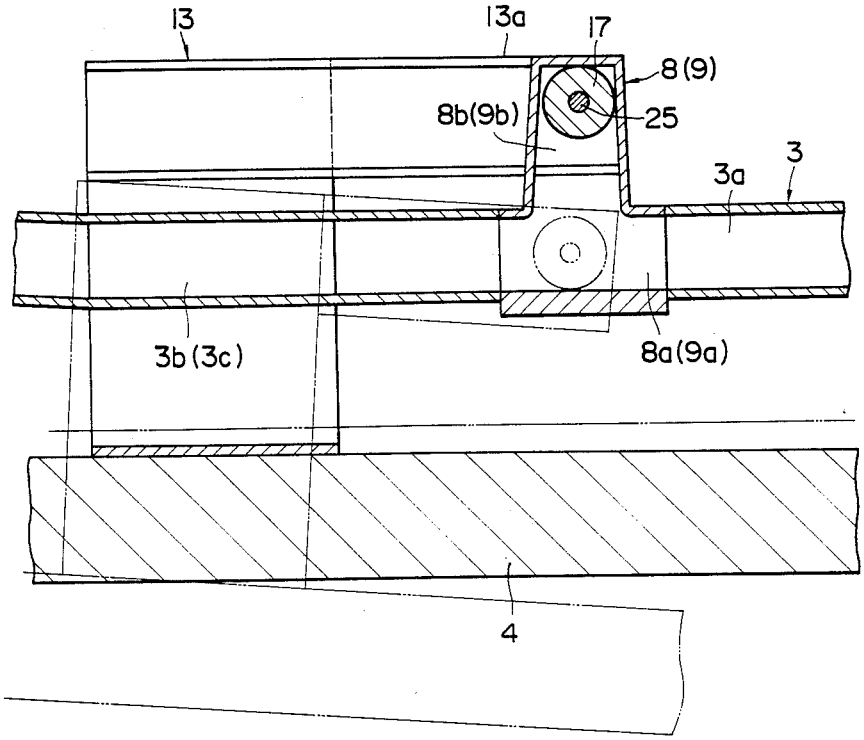
FIGS. 10 and 11 are plan and side longitudinal sectional views respectively showing a guide portion of a rail laid on the lower wall of the door mounting frame at the door rail.

The rail 2 disposed on the upper wall 1*a* of the door mounting frame 1 is formed substantially in a projecting shape in cross-section, while the rail 3 disposed on the lower wall portion 1*b* is formed substantially in a recessed shape of cross section, the rollers 14 and 15 are rotatably engaged with the rail 2 at the upper end and with the rail 3 at the lower end, and the guide portions 8 and 9 are formed substantially in a T shape as seen in FIG. 10.

Linear portions 8*a* and 9*a* of the respective guide portions 8 and 9 are secured to the frame 1 and form part of the rail 3 disposed on the lower wall 1*b* of the frame 1, and recessed grooves 8*b* and 9*b* of the respective guide portions 8 and 9 formed perpendicularly to the linear portion 3*a* of the rail 3 disposed on the lower portion wall 1*b* of the frame 1 are engaged with the runner 17.

Figure 6:
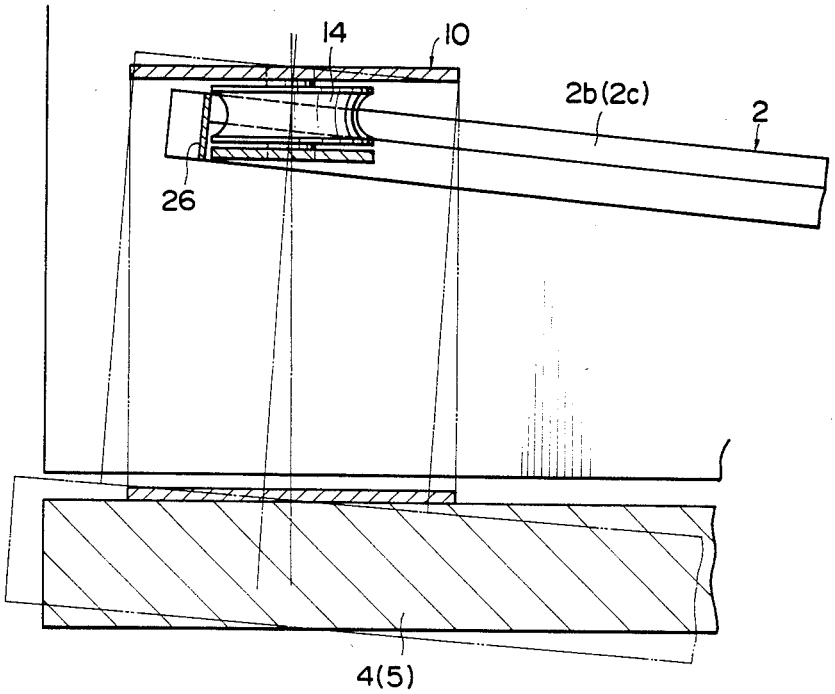
FIGS. 6 and 7 are plan and side longitudinal sectional views respectively showing the engaging structure of the rail laid on an upper wall of the door mounting frame and the upper outer end of the door.
Figure 7:
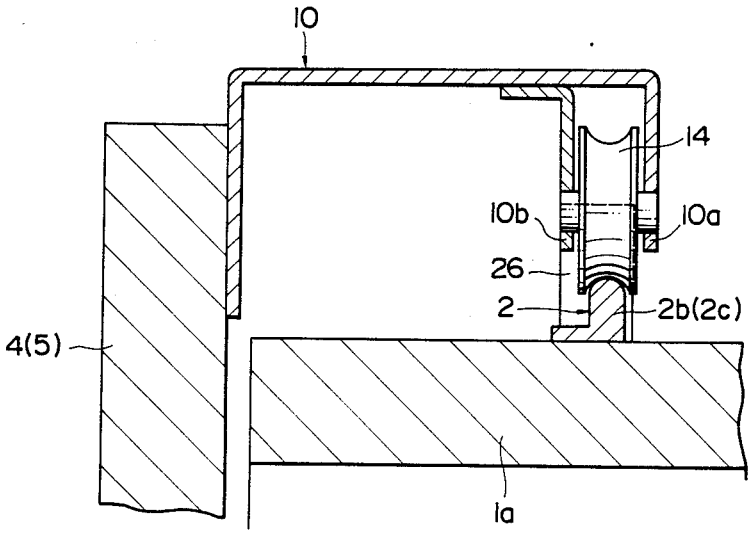

The fittings 10 which are secured fixedly to the outer upper ends of the panels 4 and 5 are, as shown in FIGS. 6 and 7, formed in a U shape cross section in such a manner that the runner 14 of roller is supported between the lower bent piece 10*a* formed at the end thereof and the mounting piece 10*b* located at a predetermined interval from the piece 10*a*.

Figure 16:
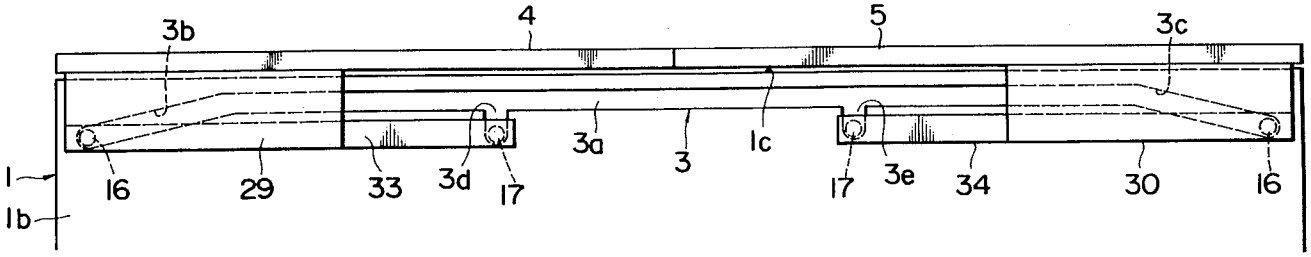

Further, the fittings 12 which are secured to the outer lower ends of the panels 4 and 5 are formed in an L shaped cross section, a stud shaft (not shown) is on one end thereof, and the roller 16 is rotatably supported on the stud shaft (FIG. 16).

In FIGS. 6 and 7, reference numeral 26 designates stoppers at both the right and left ends of the rail 2 located on the upper wall portion 1*a* of the frame 1 to position the closed panel in contact with the runner 14.

The opening and closing operations of door with the double sliding panels sliding on the door rail device of the invention thus constructed will now be described with reference to FIGS. 12(A), 12(B) and 12(C) and FIGS. 13(A), 13(B) and 13(C).

Figure 12A:
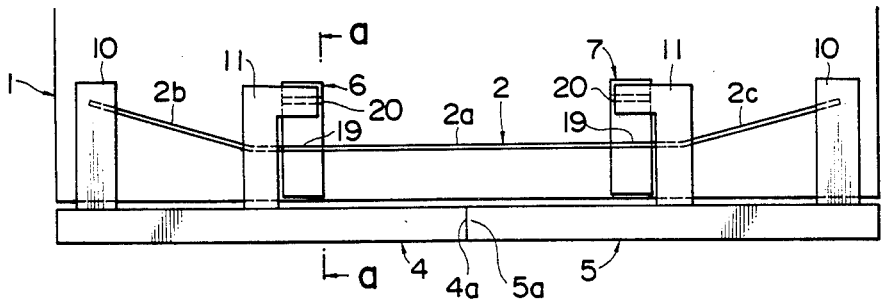
FIGS. 12(A), 12(B) and 12(C) are plan views sequentially showing the order of opening the doors on the rails.
Figure 13A:
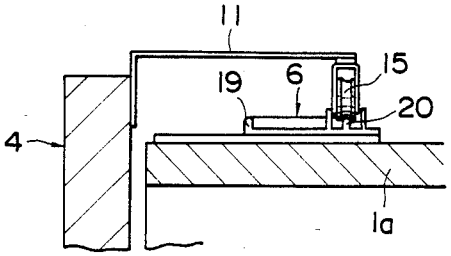
FIGS. 13(A), 13(B) and 13(C) are sectional views as seen from arrows taken along the lines a—a, b—b and c—c in FIGS. 12(A), 12(B) and 12(C), respectively.

The door panels 4 and 5 are in the closed state, as shown in FIG. 12(A). The inner ends 4*a* and 5*a* therefor abutt The panels 4 and 5 remain in the closed state in such a manner that the rollers 14 are up against the stoppers 26 on the rail ends, as shown in FIG. 6. Thus, the panels 4 and 5 are disposed in one plane and abutt at the inner ends 4*a* and 5*a* thereof. The runners 14 are engaged with the oblique portions 2*b* and 2*c* of the rail 2 in this state, while the runners 15 are engaged, as shown in FIG. 13(A), with the rail portions 20 at the rail switching portions 6 and 7.

The runners 16 are respectively engaged with the oblique portions 3*b* and 3*c* of the rail 3 on the lower wall 1*c* of the frame 1, while the runners 17 are engaged with the guide portions 8 and 9, and door panels 4 and 5 are closed without a gap at the front edge 1*c* of the frame 1.

Figure 12B:
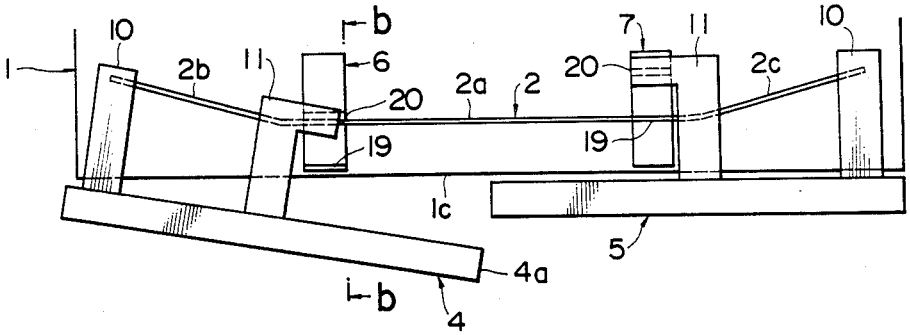
Figure 13B:
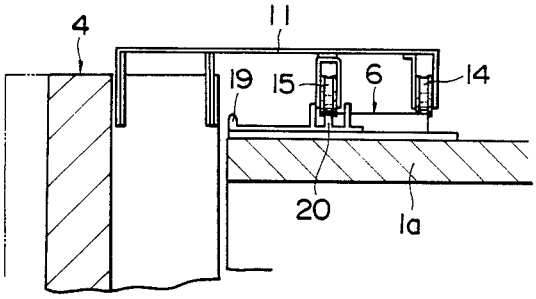

When the door panel of left side is, for example, opened from the closed state of panels 4 and 5, a knob or the like provided on the inner end 4*a* of the door 4 is gripped and pulled. This causes force to be applied to the rail switching portion 6 through the fitting 11 and the roller 15. Thus, the base plate 18, the rail portions 19 and 20 are shifted, as shown in FIGS. 12(B) and 13(B) to bring the rail portion 20 to coincide with the linear portion 2*a* of the rail 2 on the upper wall 1*a* and the panel 4 is rotated clockwise on roller 14 as a fulcrum as shown in FIG. 13(B). In this manner, the inner end 4*a* of the door 4 is shifted forward to an oblique position as shown in FIG. 12(B).

The roller 17 is then shifted to the linear portion 8*a* of the guide portion 8 at this time as shown in FIG. 10.

When the panel 4 is then moved to the right in the drawings, the rollers 14, 15 and 16, 17 (see FIG. 3) are guided to the rails 2 and 3 on the upper and lower wall portions of the frame 1 to move the right in the drawings.

Figure 12C:
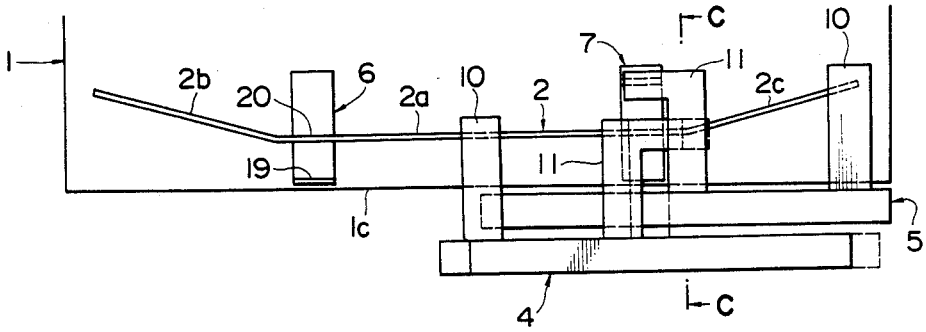
Figure 13C:
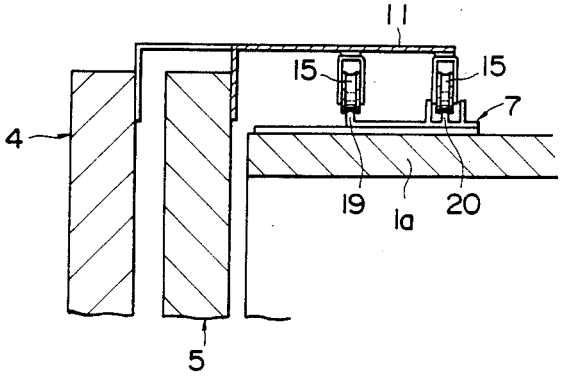

At this time the rollers 15 and 17 are disposed in advance on the linear portions 2*a* and 3*a* of the rails 2 and 3, respectively. Since the other rollers 14 and 16 are, however, engaged with the oblique portions 2*b* and 3*b* of the rails 2 and 3, and, they first start at an oblique angle, but rotate counterclockwise with the rollers 15 and 17 as fulcra as they move to the right (see FIG. 3), and when the rollers 14 and 16 reach the linear portions 2*a* and 3*a* of the rails 2 and 3, respectively, the panel 4 comes to be in parallel with the front edge 1*c* of the frame 1. Therefore, the panels are in the open position, the rollers 15 are engaged, as shown in FIGS. 12(C) and 13(C), with the rail portion 19 at the rail switching portion 7 shifted by the right panel 5 immediately before the panels are fully opened and stopped. After the panel 4 is further moved to the right, the fitting 11 makes contact with the corresponding fitting 11 of the other panel 5 as shown by the two-dotted broken line in FIG. 12(C), the panels are fully opened and stopped, and the panel 4 is superposed over the outside of the other panel 5.

The panels 4 and 5 do not completely coincide over one another in the opened door position as shown, but this is produced from the relationship of the mounting positions of the respective fittings 11 of the panels. When they are mounted slightly on the outside of the panels, the panels 4 and 5 can be fully superposed.

When the panel 4 is closed, the panel 4 is moved leftwards from the opened door state as shown in FIG. 12(C). Then, the rollers 14, 15 and 16, 17 are guided to the linear portions 2*a* and 3*a* of the rails 2 and 3 to horizontally move to the left. When a roller 14, 16 then reaches the oblique portions 2*b* and 3*b* of the rails 2 and 3, the door 4 moves while rotating clockwise, the roller 14 makes contact with the stopper 26. The panel then comes to the position shown in FIG. 12(B).

At this time, the other roller 15 is engaged with the rail portion 20 at the rail switching portion 6 as shown in FIG. 13(B). Thus, when the panel 4 is further pushed at the inner end 4*a*, the base plate 18 is pushed to be shifted in depth through the fitting 11 and the roller 15, while the lower roller 17 is accordingly shifted in depth to be engaged with the guide portion 8. Thus, the panel 4 is closed as shown in FIG. 12(A), and is contained in the same plane as the other panel 5.

Since the panel 4 is shifted forwards at the inner end 4*a* at an oblique angle at the time of the initial opening of the panel and at the fully closed time, the panel 4 may not collide with the other door panel 5 at the times of opening and closing the door and, and it is not necessary to provide chamfered parts at the inner ends 4*a* and 5*a* of the panels 4 and 5, and the door can be closed without a gap between the panels 4 and 5.

Further, when the other panel 5 is opened and closed, the panel 5 operates in the same manner as the operation of the door panel 4, and the description of the operation panel 5 will be omitted.

Figure 14:
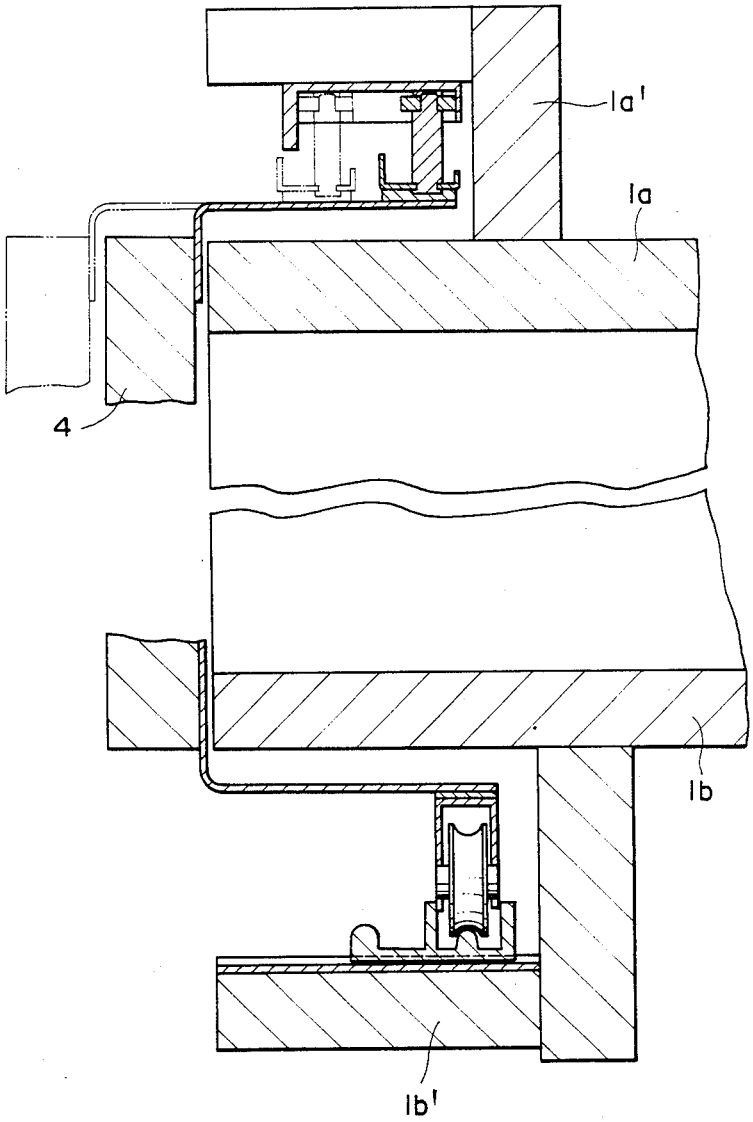
FIG. 14 is a longitudinal sectional side view of another embodiment of the invention.

FIG. 14 shows an embodiment in which the rails 2 and 3 are disposed upside down, and suitable auxiliary members 1*a*′ and 1*b*′ are respectively attached to the upper and lower wall portions 1*a* and 1*b* of a door mounting frame 1 so that the upper wall portion 1*a* is guided and the lower wall portion 1*b* is hung.

Figure 21:
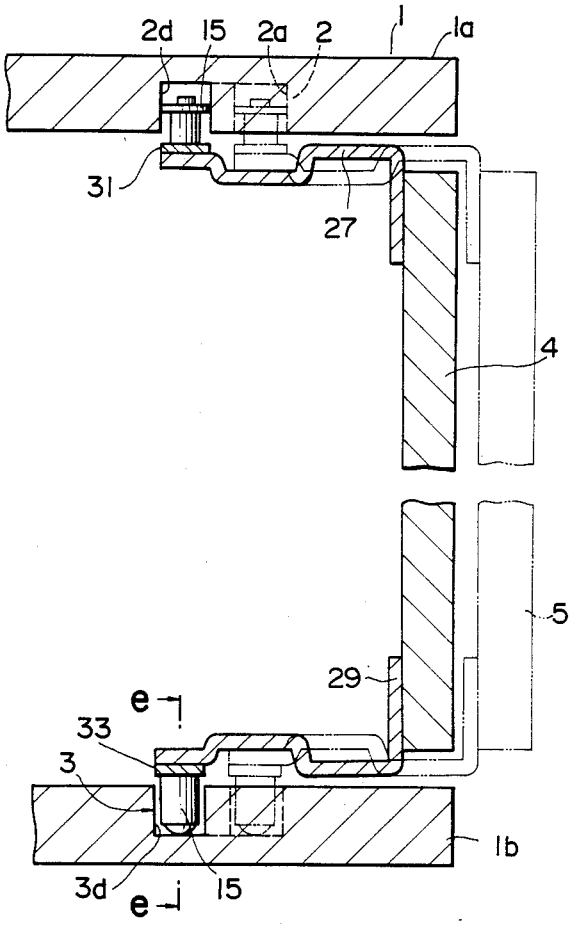
FIG. 21 is an enlarged longitudinal sectional side view of the used state of the rails of still another example of the invention.
Figure 22:
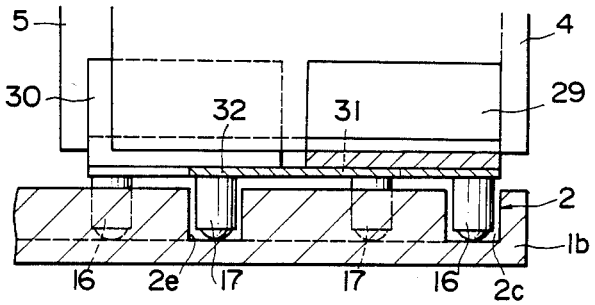
FIG. 22 is a longitudinal sectional view as seen from an arrow along the line e—e in FIG. 11.

Another embodiment of a double sliding door rail device constructed according to the present invention where the closed panels lie in one plane will now be described with reference to FIGS. 15 to 22. FIGS. 15 to 22 show an outset double sliding door panel rail device, while FIGS. 21 and 22 show an inlet double sliding door panel rail device.

This second embodiment of the double sliding door panel rail device of the invention is fundamentally constructed and operated in the same manner as those of the first embodiment of the invention, wherein the same reference numerals in the second embodiments as those in the first embodiment designate equal or equivalent parts. However, in the second embodiment of the invention, door rails 2 and 3 on upper and lower wall portions of a door mounting frame are constructed differently from those of the first embodiment of the invention, and are not formed in a projection slope, but are formed in a recessed state. Thus, in order to keep rollers 15 and 17 away from the rails 2 and 3, recesses 2*d*, 2*e* and 3*d*, 3*e* are provided integrally with the linear portions 2*a* and 3*a* of the rails 2 and 3 instead of the rail switching portions 6 and 7, and the guide portions 8 and 9.

Furthermore, panels 4 and 5 are disposed at the outer ends of the door mounting frame 1 to the sides of the doors, the rollers are provided at the back outer ends of brackets 27, 28, 29 and 30 which project backwards from both upper and lower back ends as well as at the back ends of arms 31, 32, 33 and 34 which extend in parallel with the doors 4 and 5, corresponding to the extended ends 11*a* and 13*a* of the fittings 11 and 13, to the inner end side of the doors 4 and 5 from the brackets 27, 29, 29 and 30, and movably engage with the door rails 2 and 3 so that the panels 4 and 5 are mounted in the opening of the door mounting frame 1.

Figure 20:
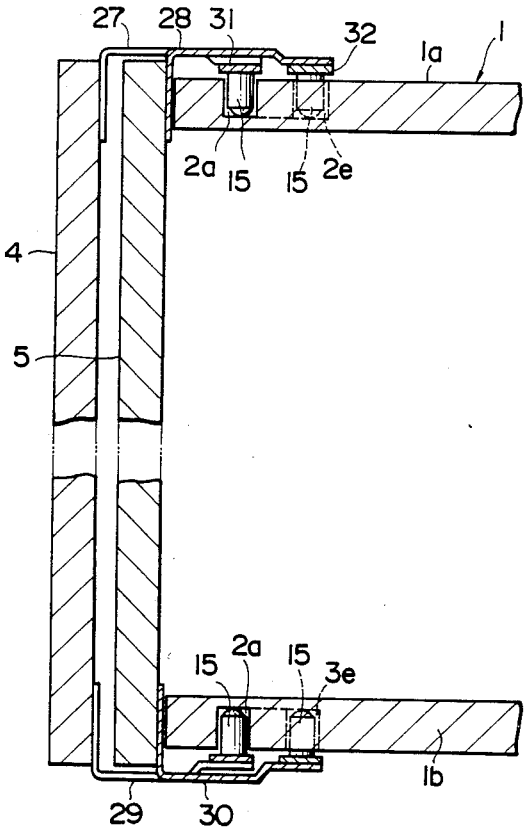
FIG. 20 is an enlarged sectional side view as seen from an arrow along the line d—d in FIG. 18.

Instead of rollers 14 to 17 in the case that the rails 2 and 3 are formed in a recessed shape it is possible to employ, as shown in FIG. 20, ball casters or slides.

Figure 18:
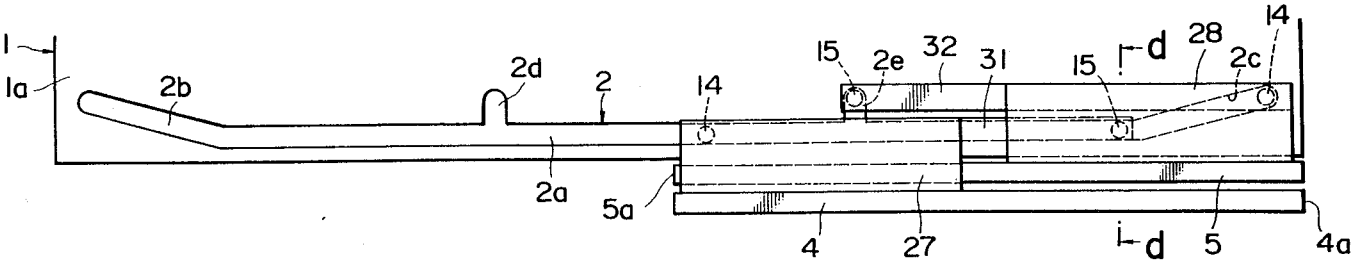

This second embodiment differs from the first embodiment of the invention in the use of recesses 2*d*, 2*e* and 3*d*, 3*e* of the rails 2 and 3 which will now be described. The recesses 2*d*, 2*e* and 3*d*, 3*e* are provided to close the left and right door panels 4 and 5 which are opened by shifting one door from the other so that the panels are superposed and are laterally slidable from one another or to open the panels 4 and 5 which are closed by reversibly shifting the one panel in depth so that the panels 4 and 5 abut so as to close the door, and to increase the amount of opening between the panels by guiding the rollers 15, and 17 of the arms 31 to 34 without abutt contacting, and preventing the brackets 27, 28 and 29, 30 of the panels 4 and 5 from entering into butt contact due to the lateral opposite movements of the rollers 15 and 17 of the brackets of the door as shown in FIG. 18 when the arm of one panel enters under the bracket of the other panel so as to open the panels so that either one panel 4 or 5 is shifted so as to be completely superposed on the other door.

Figure 17:
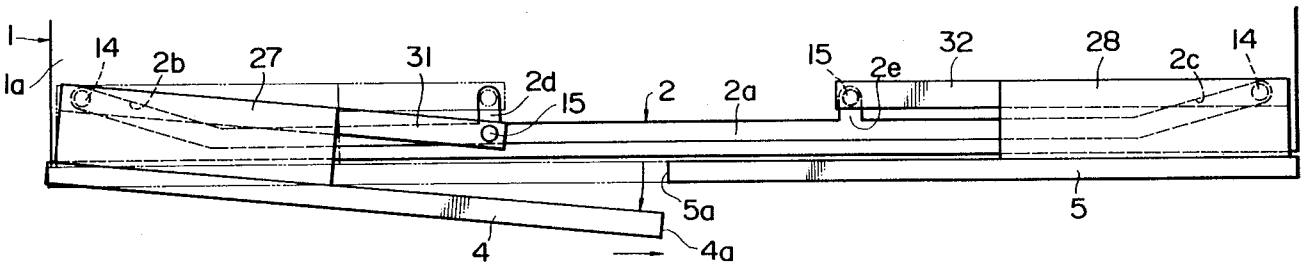
FIGS. 17 and 18 are plan views sequentially showing the order of opening the doors on the rails.
Figure 19:
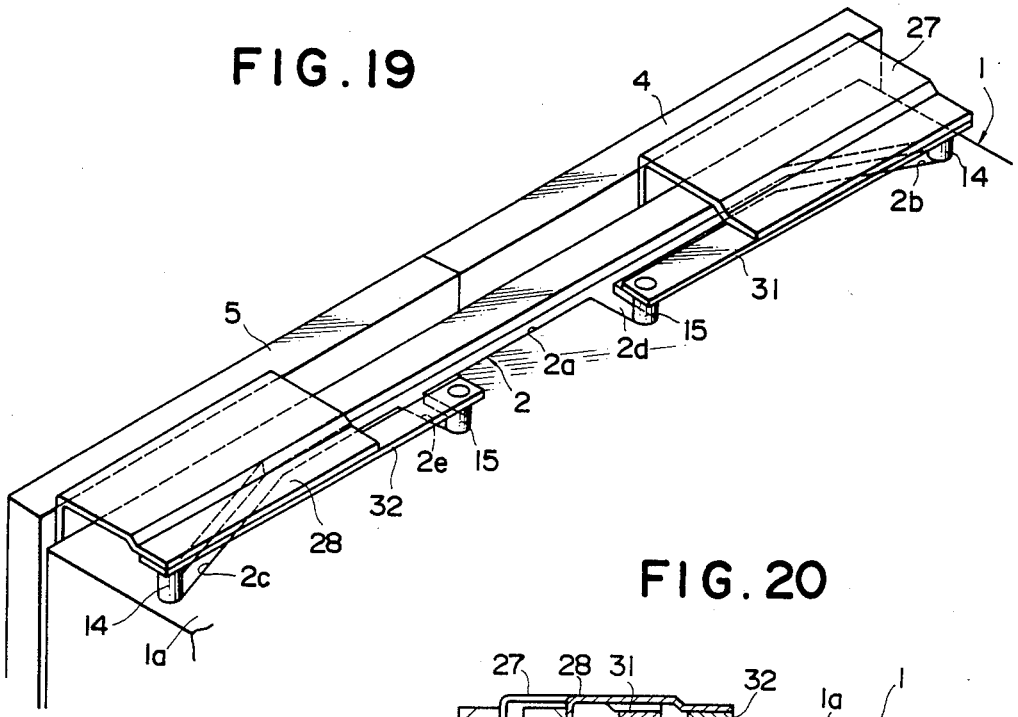
FIG. 19 is a perspective view of the used state of the rails of another example of the invention.

Accordingly, the brackets 27, 29, 29, 30 and the arms 31, 32, 33, 34 of the left and right panels 4 and 5 are, as shown in FIGS. 17 and 19, at the arms 31, 32 or 33, 34, disposed in parallel to each other longitudinally so as to enter under the bracket of the other panel at the time of opening the door.

In the structure of the recesses 2*d*, 2*e* and 3*d*, 3*e*, as shown in FIGS. 19 and 20, when the linear portions 3*a* and the oblique portions 2*b*, 2*c* and 3*b*, 3*c* are formed in a groove shape, they are formed similar to and substantially perpendicularly to the linear portions 2*a*, 3*a*.

In the embodiment shown, the brackets 27 to 30 and the arms 31 to 24 are provided at the upper and lower ends of the left and right panels 4 and 5, the rollers 14, 15 and 16, 17 are provided in engagement with the rails 2 and 3, and the panels 4 and 5 are supported at the upper and lower ends. However, the invention is not limited only to this embodiment. For example, the panels 4 and 5 may be supported only at the upper ends in a hanging type, or may be supported only at the lower ends in a sliding type, in which cases, the other ends of the panels 4 and 5 may preferably also be guided so that the panels 4 and 5 are guided through slippage preventing means or sliding means movable along the rail 2 to the upper or lower wall portion 1*a* or 1*b*.

FIGS. 21 and 22 show an inset arrangement of the invention.

In this case, the door rails 2 and 3 which are disposed on upper and lower wall portions of a door mounting frame 1 are placed oppositely on the inner surfaces of the upper and lower wall portions 1*a* and 1*b*, and the rails 2 and 3 are formed of linear portions 2*a*, 3*a*, oblique portions 2*b*, 2*c* and 3*b*, 3*c*, and recesses 2*d*, 2*e* and 3*d*, 3*e* in the same manner as the outset arrangement but the oblique portions 2*b*, 2*c* and 3*b*, 3*c* are bent backwards, the recesses 2*d*, 2*e* and 3*d*, 3*e* are provided integrally from the linear portions 3*a* and 3*a* substantially perpendicularly in the depthwise direction, and when the panels 4 and 5 are opened or closed, they are rotated beforehand as shown by the two-dotted broken line in FIG. 11.

The panels 4 and 5 are provided at the upper and lower ends thereof with brackets 27 to 30 and arms 31 34 on the back surfaces thereof in the same manner as in the previous embodiment, also with rollers 14, 15 and 16, 17 are disposed outwardly in engagement with the rails 2 and 3.

In this embodiment, the rails 2 and 3 are formed in a recessed groove shape directly on the inner surfaces of the upper and lower walls portions 1*a* and 1*b*. The rollers 14 to 17 are ball casters at the lower ends and where rollers at the upper ends. However, the embodiment is not limited only to this structure. For example, the rails 2 and 3 may be formed in a projecting shape in the same manner as in the first embodiment, or slides or rollers may be used.

Also in this case, the brackets 27 to 30 and the arms 31 to 34 of the left and right panels 4 and 5 are provided to be superposed in the open door state.

Figure 15:
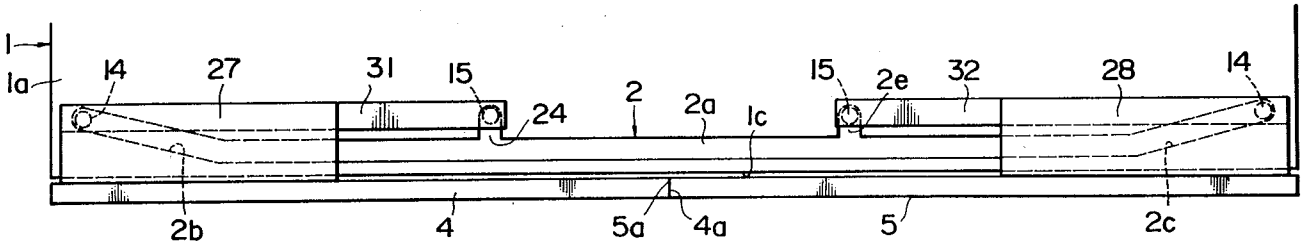
FIGS. 15 and 16 are plan and bottom views respectively showing the used states of the plan shut double sliding door rails constructed according to the present invention.

The opening and closing operations of this embodiment are carried out in the same manner as those of the first embodiment, and the device may be operated from the closed door state of abutting inner ends 4*a* and 5*a* of the doors 4 and 5 as shown in FIG. 15, to first pull the inner end of the door 4 as shown in FIG. 17, and then to move the door to the right to obtain the open door state as shown in FIG. 18. In this open door state, the arms 31, 33 of the door 4 are guided under the brackets 28, 30 provided at the right panel 5. Thus, since the both members do not collide, the amount of opening of the panel 4 increases, with the result that the panels 4 and 5 are completely superposed on one another.

When the panel 4 is closed, the operations are reversed as described. It is to be observed therefor that the first embodiment comprises a door rail 2 on an upper wall portion 1*a* for right and left double sliding panels 4 and 5 and a rail 3 on a lower wall portion 1*b*, of a door mounting frame 1 to laterally and movably guide right and left panels via runners 14, 15 and 16, 17 such as rollers provided at upper and lower ends of the both right and left sliding panels, said rails 2, 3 having at both right and left side thereof linear portions 2*a*, 3*a* formed at the center, oblique portions 2*b*, 2*c* and 3*b*, 3*c* bent backwardly at the right and left ends of the linear portions, rail switching portions 6, 7 provided at the rail 2 at both right and left side and guide portions 8, 9 provided at the rail 3 in such a manner that the panels 4 and 5 are operated at the initial time of opening the door so that the panels 4, 5 are tiltably moved from one another forwards to be shifted to be superposed from one another. Thus, the left and right panels 4 and 5 can be superposed by the rail 2 on the upper wall portion and the rail 4 on the lower wall portion of the rail mounting frame, and the panels 4 and 5 are tilted forwards at the door closed position so that the inner ends 4*a* and 5*a* of the panels 4 and 5 do not interfere with one another. Accordingly, it is not necessary to chamfer the inner ends 4*a* and 5*a* of the doors, nor needed to provide a gap between the panels 4 and 5.

Since the rail switching portions 6, 7 provided at both right and left of the rail 2 are provided to guide the runners 15 of the other panel, the panels 4 and 5 can be completely superposed so as to open the door, an extremely small gap may be provided between the opening edge 1*c* of the rail mounting frame in the closed door state, and the panels 4 and 5 can be fully closed in a completely closed door state without a gap between the panels 4 and 5.

According to the second embodiment in accordance with the invention described, the device comprises brackets 27, 28 and 29, 30 fixedly secured to the other ends of the panels at upper and lower ends of the right and left sliding panels 4 and 5, a rail 2 laid on an upper wall portion 1*a* and a rail 3 on a lower wall portion 1*b*, of a door mounting frame 1 to laterally guide the panels by runners 14 and 16, such as rollers provided on arms 31, 32, 33, 34 extending toward the inner ends of the double sliding panels from the brackets 27 to 30, said rails 2, 3 having at the center linear portions 2*a*, 3*a* for moving the panels 4 and 5 in parallel with each other, at the right and left side parts of central linear portion thereof oblique portions 2*b*, 2*c* and 3*b*, 3*c* bent backwards to be tilted at the runners 14 and 16 as fulcra at the outer ends of the panels at the door opening or closing time of the panels 4 and 5, and rail recessed portions 2*d*, 2*e* and 3*d*, 3*e* in the vicinity of the linear portions at both sides in such a manner that the sliding panels can rotate and slide forwards at the time of opening and closing so as to guide the runners 15 and 17 of the arms 31, 32, 33, 34 at the inner ends of the panels longitudinally of the panels so that the brackets 27 to 30 and the arms 31 to 34 of the panels 4 and 5 are superposed in the door open state, it is not necessary to chamfer the back surfaces of the inner ends 4*a*, 5*a* of the panels 4 and 5, nor to form a gap between the panels 4 and 5, and the panels can be moved in a superposed state by rails 2 and 3 on the upper and lower wall portions of the frame at the door opening time, the panels 4 and 5 can be readily mounted inexpensively. Further, since the tail recess portions 2*d*, 2*e* and 3*d*, 3*e* are provided at the right and left of the linear portions 2*a* and 3*a* of the rails 2 and 3 so that the runners 15 and 17 of the arms 31 to 34 are detachable at the door opening or closing time and the panels 4 and 5 are closed so as to be in one plane, in such a manner that the runners 15 and 17 are engaged with the recessed portions 2*d*, 2*e* and 3*d*, 3*e*. Thus, even if the arms 31 to 34 are extended to the vicinity of the inner ends 4*a*, 5*a* of the panels 4 and 5 so that the runners 15 and 17 are provided at the ends, no interference occurs between the arms 31, 32 and 33, 34 of the panels 4 and 5, between the arms 31 to 34 and the brackets 27 to 30, and further between the brackets 27, 28 and 29, 30 at the door opening and closing times, and further the arms 31 to 34 are guided under the brackets 27 to 30 at the door opening time, the door opening space of the panels 4, 5 is increased. Thus, the panels 4, 5 can be completely superposed in the open state. In this way, when the opening is increased in the panels 4, 5, articles can be preferably introduced into or removed from the interior of a cabinet or the like. Moreover, since the panels 4, 5 can be supported by two runners 14 and 17 in the lateral width of the panels 4, 5, the panels are stably supported without any undersirably lateral and longitudinal movement even if considerably large and heavy panels are used.

What is claimed is:

1. A double panel door arrangement wherein the two panels will be disposed with their inner edges flush up against one another when the door is closed and one panel will be superposed over the other when the door is open, said arrangement comprising in combination:

(a) an elongated frame (1) defining a plane and a frame inner and outer side, with upper and lower wall portions (1*a*, 1*b*), a defined travel path (2, 3) with stop ends disposed longitudinally across said frame, said travel path having a linear portion (2*a*) and outer end sections;

(b) inwardly bent oblique equal path portions (2*b*, 2*c*, 3*b*, 3*c*) at said end sections, travel path switching portions (6, 7) in the vicinity of the ends of said linear portion (2*a*), a slidable base plate (18) holding said switching portions (6, 7) first and second route portions (19, 20) over said base plate (18), said route portions (19, 20) being selectively slidable over said base plate;

(c) equally sized rectangular panels (4, 5) with inner edges which are to abutt each other in the door closed position, said panels being disposed to slide along said travel path; and, (d) one and another runner means (14, 15) affixed to said panels to travel said travel path and engage said route portions (19, 20), one runner means being at said stop ends at the door closed position and engaged with said oblique path portion as a fulcrum, the other runner means engaging said switching position (6, 7) route portion so as to move one panel obliquely when opening the door and then guiding said panel to be superposed alongside the other panel when the door is opened.

2. An arrangement as claimed in claim 1 wherein said switching positions consist of a recess disposed perpendicularly to said defined plane, an elbow (11) affixed to each of said panels (4, 5) L-shaped in cross-section with an outer end and runner means (15) at said outer end engaging one of said switching positions.

3. An arrangement as claimed in claim 2 wherein said travel path is at least one rail and the runner means are rollers.

4. A double panel door arrangement wherein the two panels will be disposed with their inner edges flush up against one another when the door is closed and one panel will be superposed over the other when the door is open, said arrangement comprising in combination:

(a) an elongated frame (1) defining a plane and a frame inner and outer side, with upper and lower wall portions (1*a*, 1*b*), a defined travel path (2, 3) with stop ends disposed longitudinally across said frame, said travel path having a linear portion (2*a*) and outer end sections;

(b) inwardly bent oblique equal path portions (2*b*, 2*c*, 3*b*, 3*c*) at said end sections, travel path recessed switching positions on said linear portion in the vicinity of the ends of said linear portion (2*a*), the recesses of said switching positions being perpendicular to said plane;

(c) equally sized rectangular panels (4, 5) with inner edges which are to abutt each other during the door closed position, said panels being disposed to slide along said travel path; and, (c) one and another sets of runner means (14, 15) affixed to said panels to travel said travel path, one runner means set being at said stop ends during the door closed position and engaged with said oblique path portion as a fulcrum, the other runner means engaging said switching position so as to move one panel obliquely when opening the door and then guiding said panel to be superposed alongside the other panel when the door is opened.

* * * * *